US008132647B2

(12) United States Patent
Salerno

(10) Patent No.: US 8,132,647 B2
(45) Date of Patent: Mar. 13, 2012

(54) TREE STEP SYSTEM

(76) Inventor: Douglas Joseph Salerno, Lebanon, TN (US)

( * ) Notice: Subject to any disclaimer, the term of this patent is extended or adjusted under 35 U.S.C. 154(b) by 0 days.

(21) Appl. No.: 12/977,532

(22) Filed: Dec. 23, 2010

(65) Prior Publication Data

US 2011/0088240 A1 Apr. 21, 2011

Related U.S. Application Data

(63) Continuation of application No. 11/749,363, filed on May 16, 2007, now abandoned.

(51) Int. Cl.
*A63B 27/00* (2006.01)

(52) U.S. Cl. ..... 182/92

(58) Field of Classification Search ..... 182/92
See application file for complete search history.

(56) References Cited

U.S. PATENT DOCUMENTS

| | | | | |
|---|---|---|---|---|
| 3,298,459 | A * | 1/1967 | Bergsten | 182/92 |
| 3,380,697 | A * | 4/1968 | Melcher | 248/217.4 |
| 4,449,612 | A * | 5/1984 | Southard | 182/92 |
| 4,697,669 | A * | 10/1987 | Bergsten | 182/92 |
| 4,753,447 | A | 6/1988 | Hall | |
| 4,775,030 | A | 10/1988 | Wright | |
| 4,844,207 | A | 7/1989 | Andrews et al. | |
| 5,086,873 | A | 2/1992 | George | |
| 5,624,007 | A | 4/1997 | Mahaffy | |
| 5,743,353 | A * | 4/1998 | Browning et al. | 182/92 |
| 5,816,362 | A | 10/1998 | Jenkins, Jr. | |
| 5,881,837 | A | 3/1999 | Leicht | |
| 5,899,124 | A * | 5/1999 | Cross, Jr. | 81/176.15 |
| 6,478,272 | B1 * | 11/2002 | McKinsey et al. | 248/216.1 |
| 6,726,162 | B1 * | 4/2004 | Winter | 248/218.4 |
| 2002/0029931 | A1 * | 3/2002 | Bridges | 182/92 |
| 2005/0016795 | A1 * | 1/2005 | Skipper | 182/100 |

* cited by examiner

*Primary Examiner* — Alvin Chin Shue
(74) *Attorney, Agent, or Firm* — James Addison Barry, Jr.

(57) ABSTRACT

A tree step system 100 having a tubing 110; and a step lag screw 130, whereby the tubing 110 may be used as a hammer to drive the step lag screw 130 into a tree 20 and the tubing 110 may further be used for leverage to turn the step lag screw 130 into the tree. The tree step system 100 may include a rod step 150, and an adjustable fastener 170 for adjusting the depth of the adjustable fastener 170 and preventing the tree step system 100 from rotating. The rod step centerline may be offset ninety degrees from the centerline of the step lag screw 130, whereby the offset provides for ease of climbing and entering a tree stand with the proper foot. The tubing 110 may comprise an upper tubing 114 and a lower tubing 124 for ease of installation.

7 Claims, 19 Drawing Sheets

TREE STEP SYSTEM

CROSS-REFERENCE TO RELATED APPLICATIONS

The present application is a Continuation-In-Part of the parent U.S. patent application Ser. No. 11/749,363, filed May 16, 2007, titled TREE STEP SYSTEM, currently pending. The present application is related by the same inventor for both applications, Douglas Joseph Salerno. The parent application U.S. patent application Ser. No. 11/749,363, filed May 16, 2007 is hereby incorporated in its entirety by reference.

FIELD OF INVENTION

The present invention relates to a device that may be used by hunters and others interested in using climbing steps to climb a tree.

BACKGROUND OF INVENTION

Many outdoor recreational activities require an individual to perch himself well above the ground. In deer hunting, for example, trees frequently provide the best means available to a hunter for avoiding early detection by his prey. Many hunters and other outdoor sports persons use a device commonly known as a tree step. The typical tree step is a simple single step placed in the tree or other object by screwing in one step at a time with the aid of wrenches or other tools. There is a need for tree steps that may be mounted on a tree or object without the requirement for hammers, wrenches or other tools for affixing the tree steps.

SUMMARY

A tree step system having a tubing; and a step lag screw, whereby the tubing may be used as a hammer to drive the step lag screw into a tree and the tubing may further be used for leverage to turn the step lag screw into the tree. The tree step system may include a rod step, an adjustable fastener for adjusting the depth of the adjustable fastener and preventing the tree step system from rotating, or a combination of a step and stop for preventing rotation. The rod step centerline may be offset ninety degrees from the centerline of the step lag screw, whereby the offset provides for ease of climbing and entering a tree stand with the proper foot. The tubing may comprise an upper tubing and a lower tubing for ease of installation.

BRIEF DESCRIPTION OF THE DRAWINGS

The features, aspects, and advantages of the invention will become better understood with regard to the following description, appended claims, and accompanying drawings where:

DETAILED DESCRIPTION OF THE INVENTION

The present invention relates to the field of tree steps and more specifically this invention provides a built in apparatus for delivering a hammer blow to start a threaded screw as well as built in leverage to rotate the threaded screw. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein. For the purposes of this invention, the term tubing may also include and refer to solid material. The tubing term is useful here in the traditional sense of hollow materials but also expanded to include other solid materials especially with composite or plastic materials.

Figure 1:
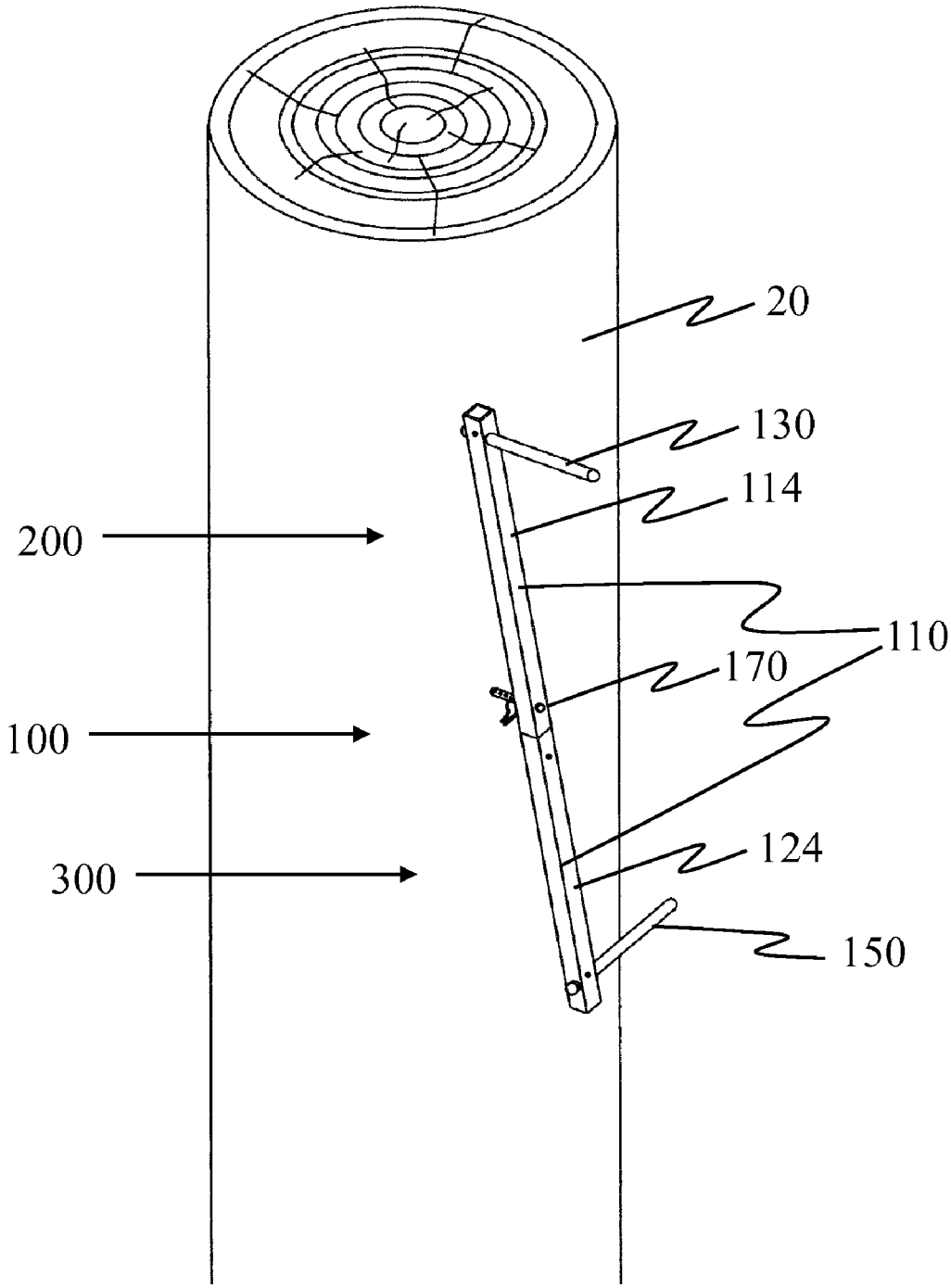
FIG. 1 is a perspective view of one embodiment of the tree step system installed according to the present invention.
Figure 13:
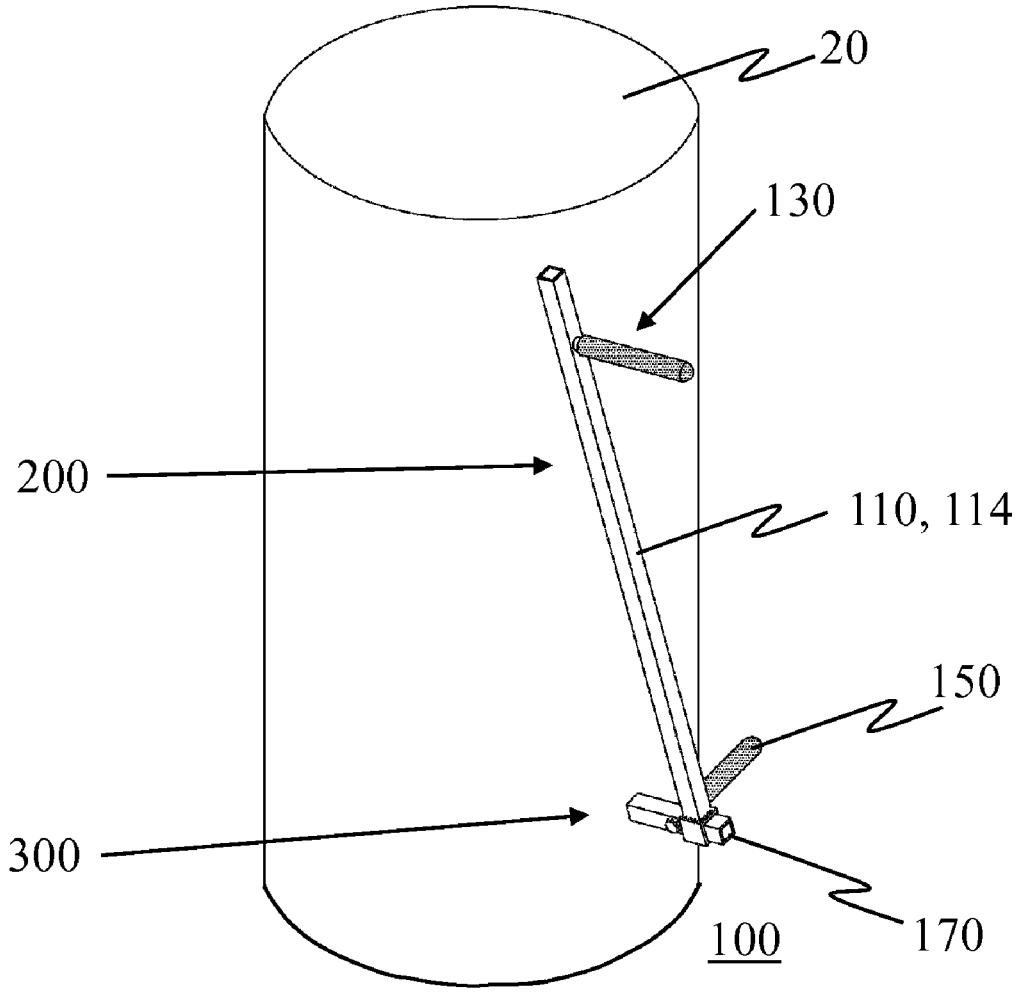
FIG. 13 is a perspective view of another embodiment of the tree step system installed according to the present invention.

Overview:

As depicted in FIGS. 1 and 13, a tree step system 100 and method for installation of the tree step system 100 having a tubing 110; and a step lag screw 130 secured to the tubing 110, whereby the tubing 110 may be used as a hammer handle to drive the step lag screw 130 into a tree 20 and the tubing 110 may further be used for a leverage arm to turn the step lag screw 130 into the tree 20. The tree step system 100 may include a rod step 150, and an adjustable fastener 170 for adjusting the depth of the adjustable fastener 170 and preventing the tree step system 100 from rotating. The rod step centerline may be offset ninety degrees from the centerline of the step lag screw 130, whereby the offset may provide for ease of climbing and entering a tree stand with the proper foot. For efficiency, the rod step 150 and adjustable fastener 170 may comprise a combination including a stop step tubing bottom member 300 that may further provide adjustability. In some embodiments the tree step system 100 may comprise an upper tubing 110 and a lower tubing 124.

Design Specifications:

As depicted in different embodiments in FIGS. 1 through 17D, a tree step system 100 includes a step lag screw 130 and tubing 110.

Figure 3A:
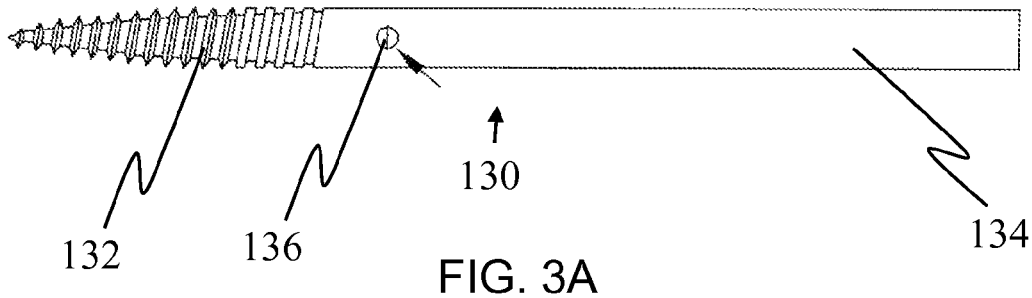
FIG. 3A is a side view of one embodiment of a step lag screw according to the present invention.

Step Lag Screw:

The step lag screw 130 includes a threaded, lag screw element 132 and an upper step element 134. The step element 134 and the threaded element 132 may form a one piece element that includes an approximately straight alignment without any curves or bends as illustrated in FIG. 3A. Further embodiments of the step lag screw 130 may comprise a threaded element 132 and a step element 134 wherein the separate threaded element 132 and the separate step element 134 attach with the tubing 110 however the centerline of the threaded element 132 and the centerline of the step element 134 may or may not be required to have centerline alignment with each other. One embodiment of the tree step system 100 may include a step lag screw 130 wherein the length of the step lag screw 130 is 7.5 inches, the diameter of the step element 134 is 0.4375 inches, the threaded element 132 is approximately 2.5 inches and a step lag screw pin aperture 136 is 2.8 from the threaded element end of the step lag screw 130 with a step lag screw pin aperture 136 of 0.156 inches. One embodiment may include a metal step lag screw; other embodiments may include a composite or plastic step lag screw while even other embodiments may include the metal step lag screw embedded in the plastic or composite. With another embodiment, the upper step element 134 may include a flexible sticky material, rubber grip, or grip tape 139 for improving the footing and the hand grip associated with the upper step element 134 or the step lag screw 130.

Figure 4:
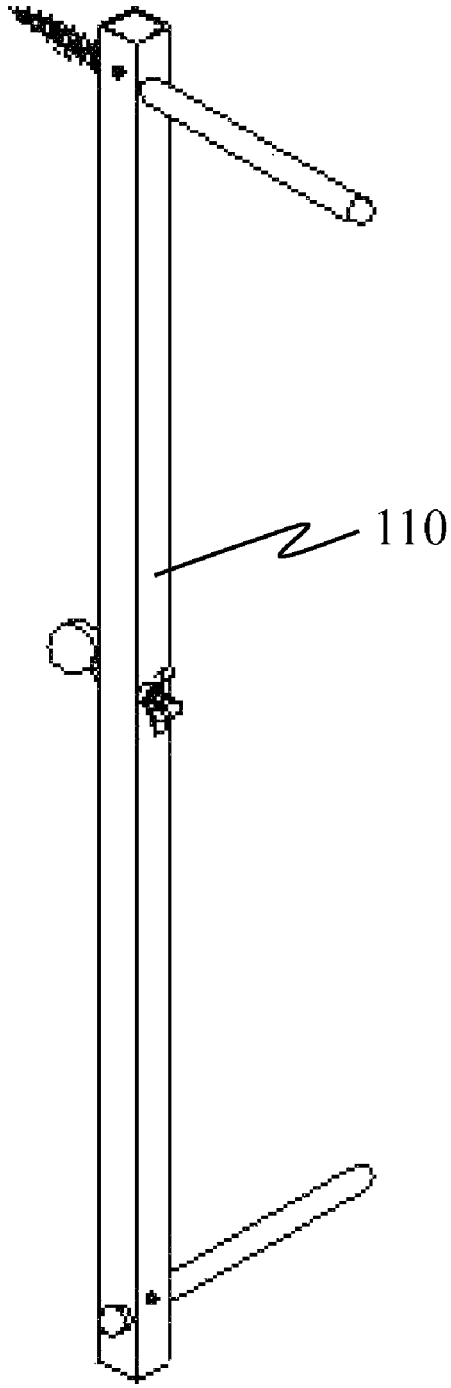
FIG. 4 is a perspective view of another embodiment of the tree step system with a single member tubing according to the present invention.
Figure 6:
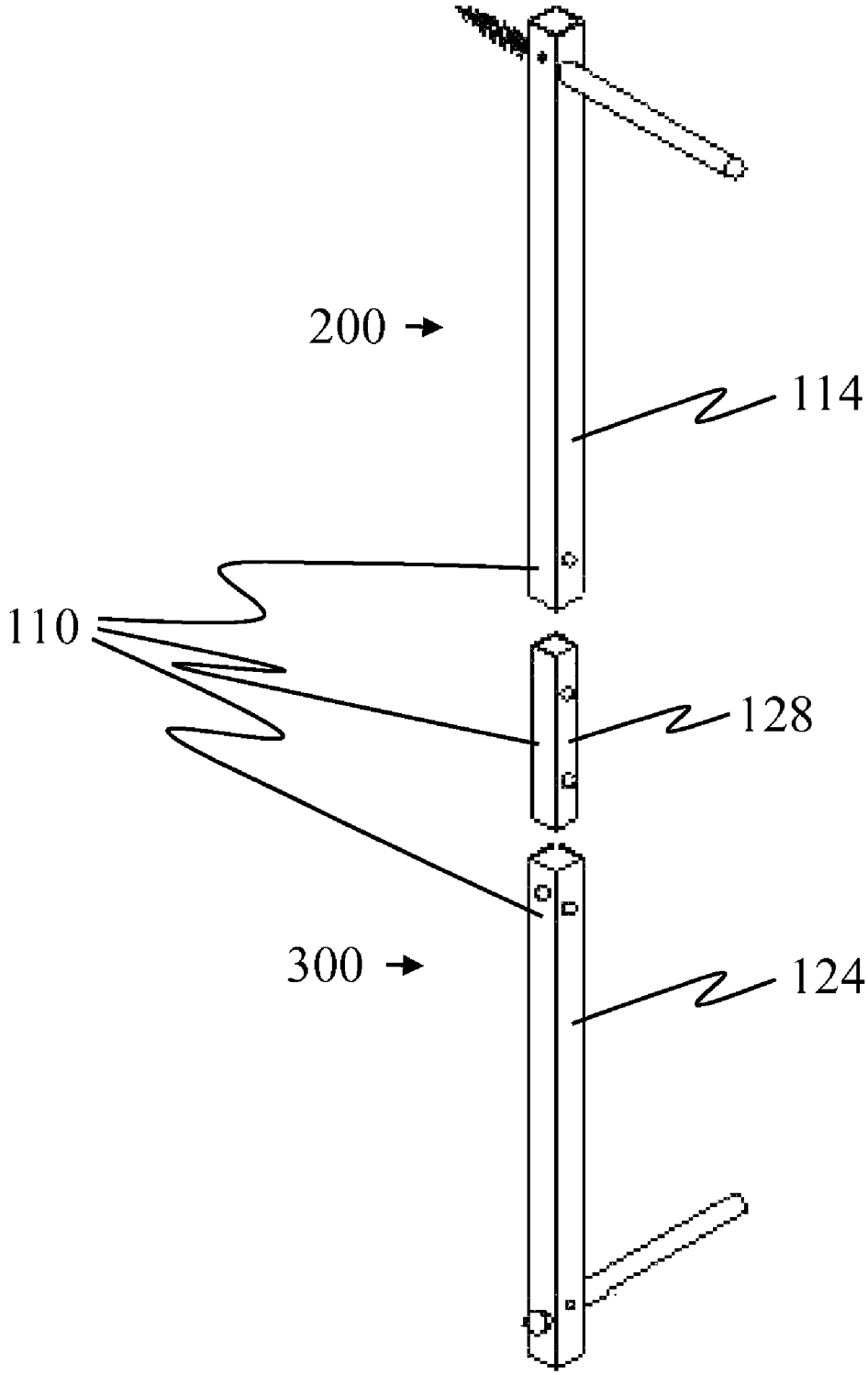
FIG. 6 is a perspective view of still another embodiment depicting an inner tubing for a tree step system according to the present invention.
Figure 7A:
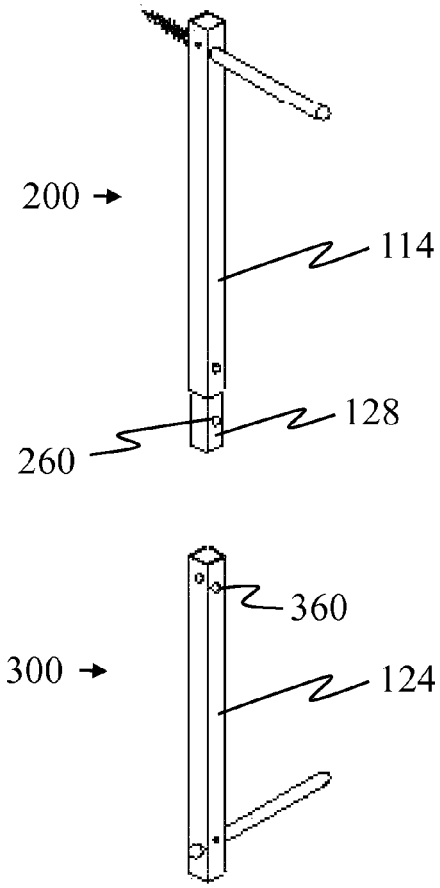
FIG. 7A is a perspective view of another embodiment of a tree step system showing the inner tubing secured with the upper tubing according to the present invention.
Figure 7B:
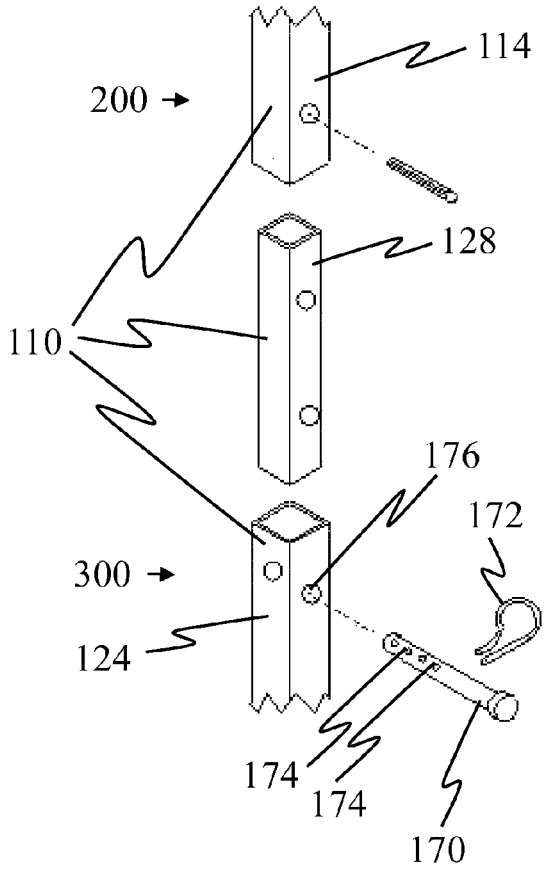
FIG. 7B is a perspective view of the tree step system of FIG. 7A depicting the inner tubing secured with the upper tubing illustrating the use of fasteners with one embodiment according to the present invention.
Figure 8A:
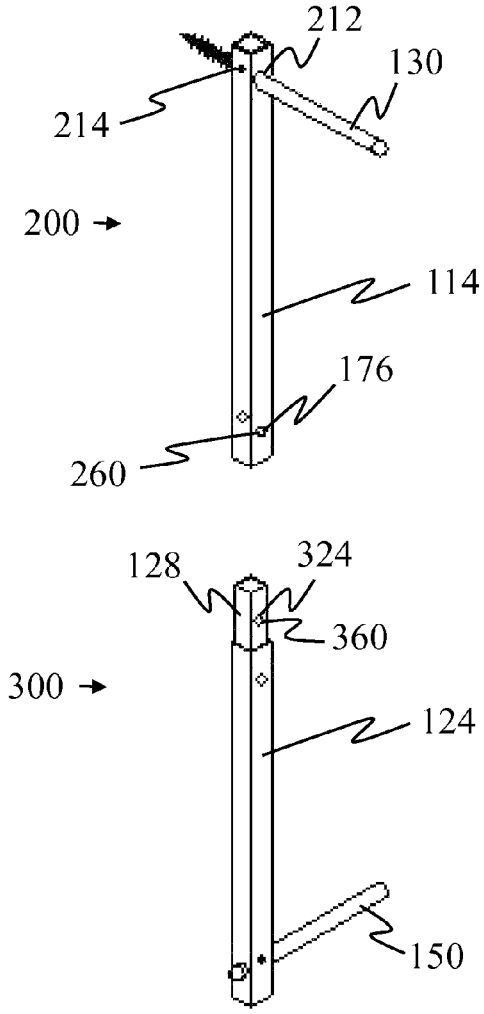
FIG. 8A is a perspective view of yet another embodiment of a tree step system showing the inner tubing secured with the lower tubing according to the present invention.
Figure 8B:
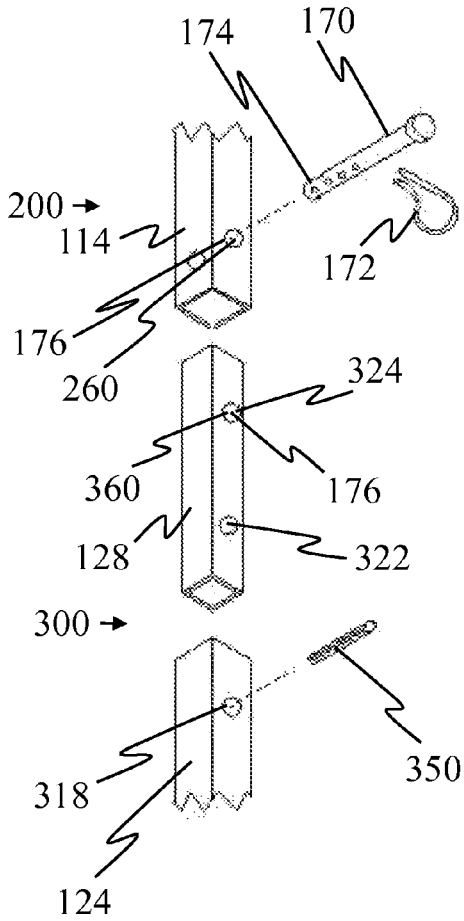
FIG. 8B is a perspective view of the tree step system of FIG. 8A depicting the inner tubing secured with the lower tubing illustrating the use of fasteners with one embodiment according to the present invention.
Figure 9:
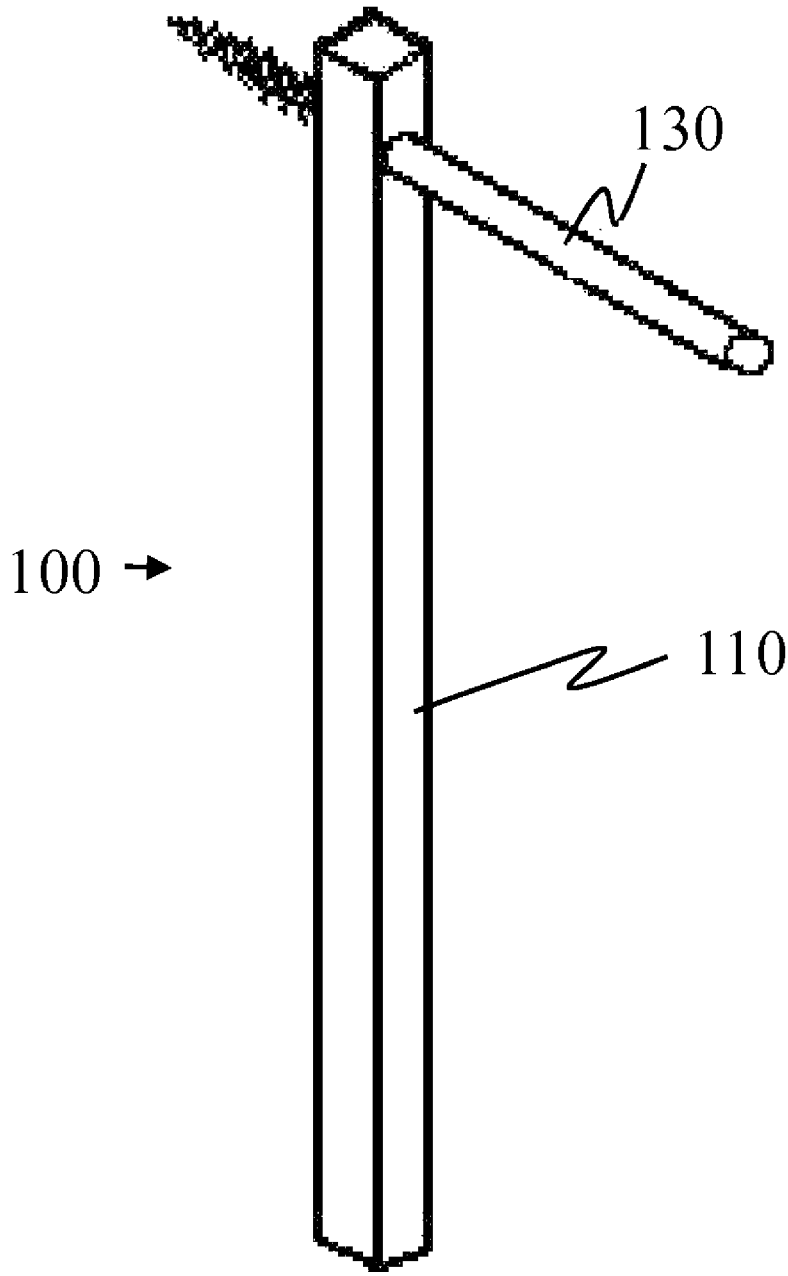
FIG. 9 is a perspective view of another embodiment of the tree step system according to the present invention.

Tubing:

Tubing 110 may be different types of geometric shaped tubing 110 including but not limited to square, round, or rectangular tubing and may have fabricated material including but not limited to ferrous and non-ferrous metals, aluminum, steel, plastics, and composites. The tubing 110 may be a single tubing member as illustrated in FIGS. 4, and 9 or multiple tubing members as illustrated in FIGS. 1, 2, 5A through 8, and 11 through 15B. Where multiple tubing members are used, the tree step system 100 may be structurally described in two sections: a top member 200 and a bottom member 300. As shown in FIGS. 4, and 9, one embodiment may include the single member tubing configuration. As depicted in FIGS. 1, 2, 5A through 8, and 11 through 15B, a multiple member embodiment may include a top member 200 including an upper tubing 114 and bottom member 300 including a lower tubing 124 or stop step 370 where one tubing is small enough to be inserted into the other tubing but large enough to produce a snug fit for security of the two members. As shown in FIG. 6, an embodiment may include an upper tubing 114, a lower tubing 124, and an inner tubing 128 where the inner tubing 128 may be inserted into the upper tubing 114 and the lower tubing 124 to aid in attaching the top member 200 and the bottom member 300. In this embodiment the upper and lower tubing 114, 124 may be the same size with the inner tubing 128 smaller than the upper or lower tubing 114, 124 so that the inner tubing 128 may be inserted in the upper and lower tubing 114, 124. As illustrated in FIGS. 7A and 7B, the inner tubing 128 may be secured to the upper tubing 114 and inserted into the lower tubing 124 during assembly in one embodiment; or as illustrated in FIGS. 8A and 8B the inner tubing 128 may be secured to the lower tubing 124 and inserted into the upper tubing 114 during assembly in another embodiment. A positive stop results from the lower tubing 124 contacting the upper tubing 114 thus aligning the top member adjustable fastener aperture 260 and bottom member adjustable fastener aperture 360.

Figure 3B:
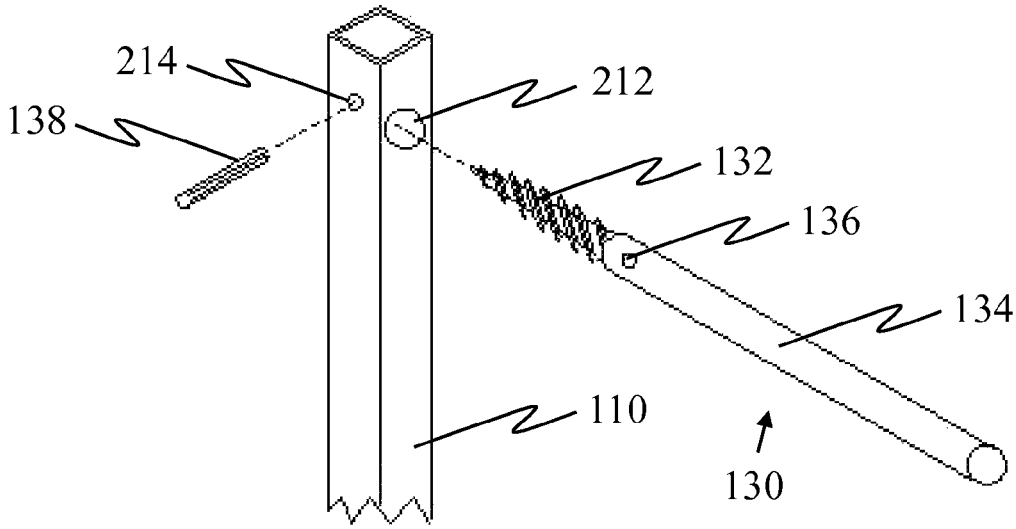
FIG. 3B is a perspective view of one embodiment of the step lag screw assembly with tubing according to the present invention.

Step Lag Screw and Tubing:

The combination of the step lag screw 130 and the tubing 110 secured together as shown in FIG. 9 allow the tree step system 100 to be used as a hammer to drive the step lag screw 130 into a tree 20 and the tubing 110 further used for leverage to turn the step lag screw 130 into the tree to further secure the tree step system 100 in the tree. The step lag screw 130 and the tubing 110 may be secured together by being formed as one molding or formed separately and joined together. As depicted in FIG. 3B, one embodiment may comprise a tubing 110 including a step lag screw aperture 212 or hole for the step lag screw 130 to be inserted into and the tubing 110 and the step lag screw 130 having a step lag screw pin aperture 136 wherein a step lag screw pin 138 may be inserted into the step lag screw aperture 212 to secure the step lag screw 130 with the tubing 110. Other embodiments for securing the step lag screw 130 with the tubing 110 may include but not be limited to pins, conventional nuts and bolts, welding, glue, rivets, or clips. A further embodiment may include the bottom member 300 comprising a stop step such as a T-shaped tubing structure 370 as illustrated in FIGS. 13-15B and 17A-17D.

Means for Stepping and Stopping Rotation, Means for Holding the Means for Stepping and Stopping Rotation, and Means for Driving and Rotating:

As illustrated in FIGS. 13 through 17D, embodiments of a tree step system 100 may comprise a step lag screw 130, a means for driving and rotating 110, 114 attached with the step lag screw 130, a means for stepping and stopping rotation 370, and a means for holding 175 the means for stepping and stopping rotation 370 secured with the means for driving and rotating 110, 114 wherein the means for stepping and for stopping rotation 370 is attachable with the means for holding 175. The means for driving the step lag screw 130 with a hammer motion into a tree 20 provides the leverage to drive with force the step lag screw 130 similar to using a hammer with a lag screw on the head of the hammer wherein the lag screw is driven into a tree. The means for rotating the threaded element 132 into the tree is provided with the leverage force created by the moment arm of the means for driving and provides for rotating the threaded element 132 into the tree without the need for further tools. The means for driving and rotating 110, 114 is securely attached with the threaded element 132 such that the means for driving and rotating 110, 114 remains attached with the threaded element 132 when driving and rotating 110, 114 the threaded element 132 into the tree. The means for stepping and the means for stopping rotation combined 370 provide for the means for stepping for climbing the tree and in addition provide the means for stopping rotation of the tree step system 100 in relation to the tree 20. The means for holding 175 the means for stepping and stopping rotation 370 provides for easy and convenient attaching and removing the means for stepping and stopping rotation 370 with the means for driving and rotating 110, 114. The means for driving and rotating 110, 114 may be tubing 110 attached with a step lag screw 130; tubing 110 attached with a threaded element 132 and an upper step element 134; or a one piece construction of a threaded element 132, a handle or tubing 110, and a upper step element 134 providing the function or means for driving and rotating. In one embodiment the threaded element 132 and the upper step element 134 may be in an approximately straight centerline alignment wherein in another embodiment the threaded element 132 and the upper step element 134 may be offset in alignment. The means for holding 175 the means for stepping and stopping rotation 370 may be an adjustable fastener aperture 176 in the tubing 110 attached with the step lag screw 130; in another embodiment the means for holding 175 may be a square or rectangular shaped aperture 177 secured with the tubing 110 attached with the step lag screw 130; or in yet another embodiment the means for holding 175 may be a circular shaped aperture with a key cutout 178 with the means for driving and rotating 110, 114 attached with the step lag screw 130. The means for stepping and stopping rotation 370 may comprise a T-shaped tubing structure 370 comprising a vertical structure 378 of the T-shaped tubing structure 370 and a horizontal structure 372 of the T-shaped tubing structure 370, wherein the vertical structure 378 of the T-shaped tubing 370 further comprising a size and a strength suitable for the size and weight of the user for stepping on the vertical structure 378 when the horizontal structure 372 is inserted in the means for holding 175 and the vertical structure 378 of the T-shaped tubing 370 may be offset with respect to a center of the horizontal structure 372 of the T-shaped tubing 370 such that one side of the horizontal structure of the T-shaped tubing is longer 376 than an other side of the horizontal structure 374 of the T-shaped tubing wherein the means for stepping and stopping rotation 370 is adjustable for different size trees dependent upon the side of the horizontal portion of the T-shaped tubing that is inserted in the means for holding 175. In another embodiment, the means for stepping and stopping rotation 370 may include a stop step 370 comprising a T-shaped tubing 370 including a vertical structure 378 and a horizontal structure 372 such that a user steps on the vertical structure 378 of the T-shape and the horizontal structure 372 of the T-shaped tubing includes one portion of the horizontal portion of the T-shape inserted into the stop step holder 175 and a next horizontal portion of the horizontal structure 372 contacts the tree trunk and stops rotation of the tree step system 100 in relation to the tree. In yet another embodiment, the means for stepping and stopping rotation 370 may include the stop step 370 wherein the horizontal structure 372 of the T-shaped tubing comprises both a shorter horizontal portion 374 of the horizontal structure 372 and a longer horizontal portion 376 of the horizontal structure 370, wherein the stop step 370 provides an adjustable length for different size tree trunks depending upon whether the shorter portion 374 or the longer portion 376 of the horizontal structure 372 is inserted in the stop step holder 175.

Figures 16A, 16B, 16C:
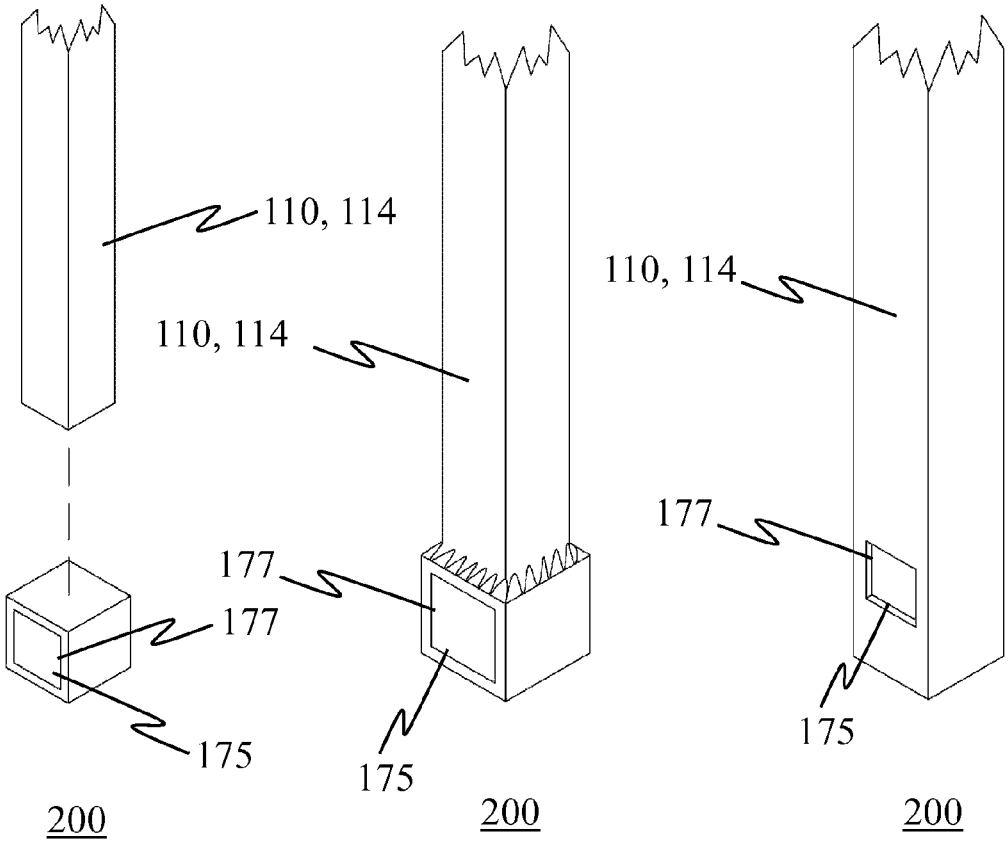
FIG. 16A is a perspective view of another embodiment of the tree step system illustrating the design of the stop step holder with the upper tubing according to the present invention.
FIG. 16B is a perspective view of another embodiment of the tree step system illustrating the attachment of the stop step holder with the upper tubing according to the present invention.
FIG. 16C is a perspective view of another embodiment of the tree step system illustrating the aperture of the stop step holder cutout with the upper tubing according to the present invention.
Figure 17A:
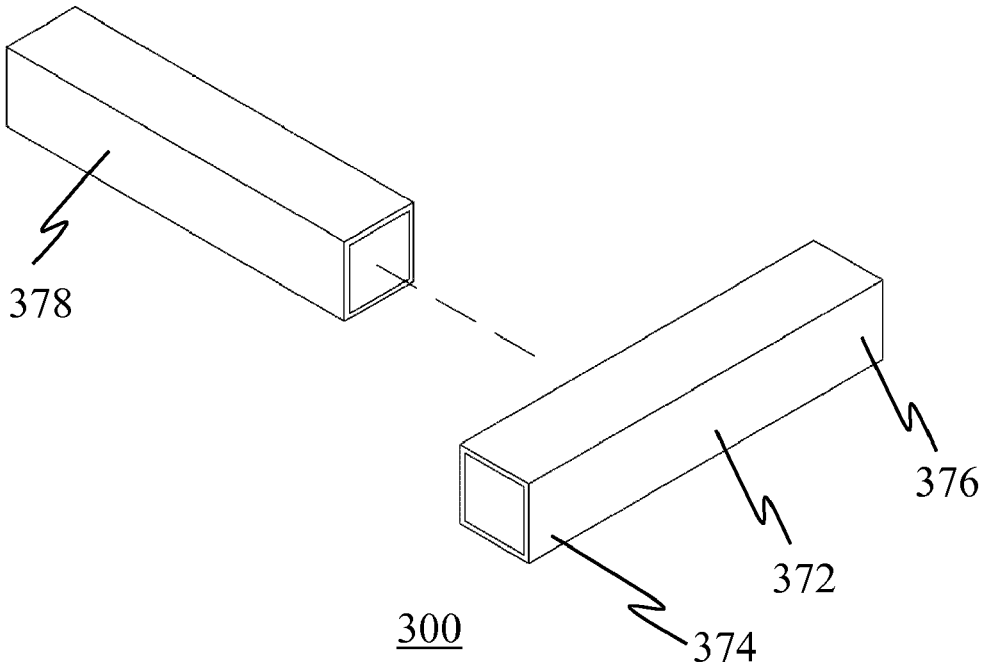
FIG. 17A is a perspective view of another embodiment of the tree step system illustrating a square tubing step design of the bottom member T-shaped stop step according to the present invention.
Figure 17B:
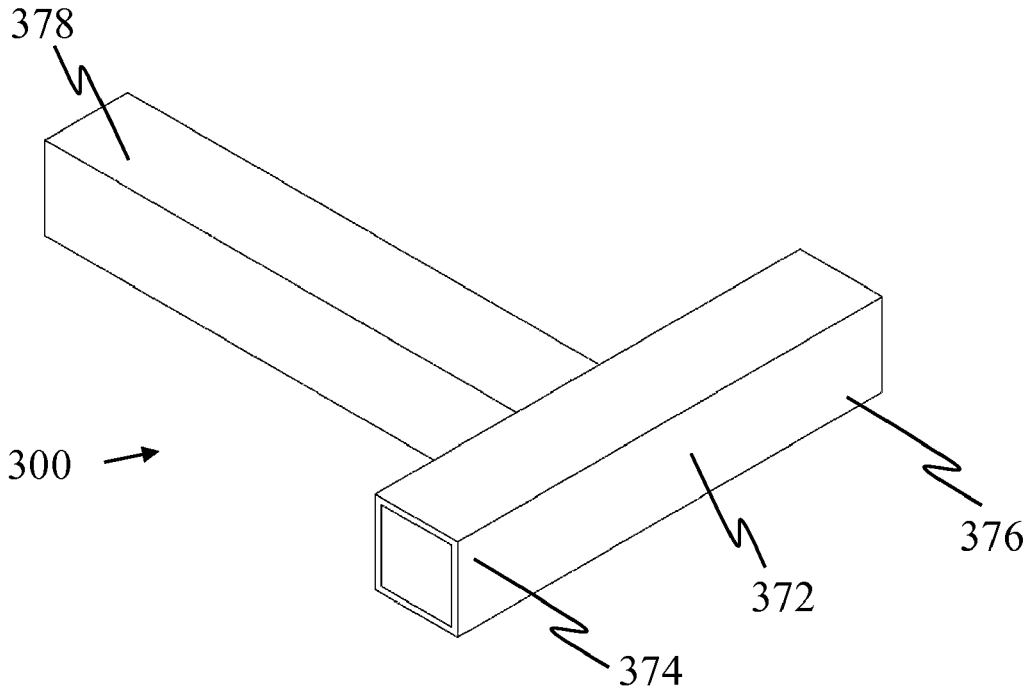
FIG. 17B is a perspective view of the embodiment of FIG. 17A of the tree step system illustrating the offset design of the T-shaped stop step affording adjustability of the stop step depth when installed with the top member according to the present invention.
Figure 17C:
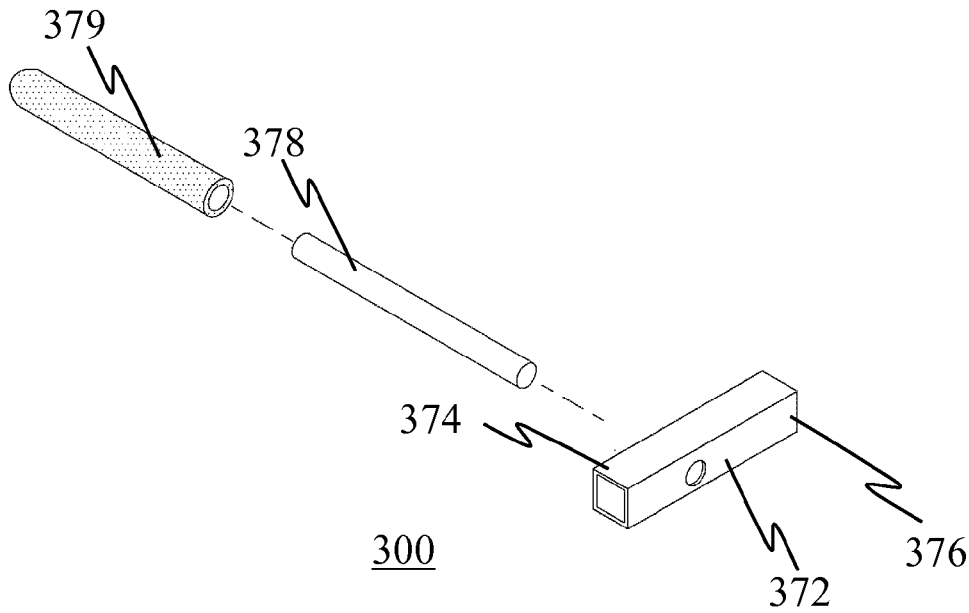
FIG. 17C a perspective view of another embodiment of the tree step system illustrating a round tubing step design with a step grip with the bottom member T-shaped stop step according to the present invention.
Figure 17D:
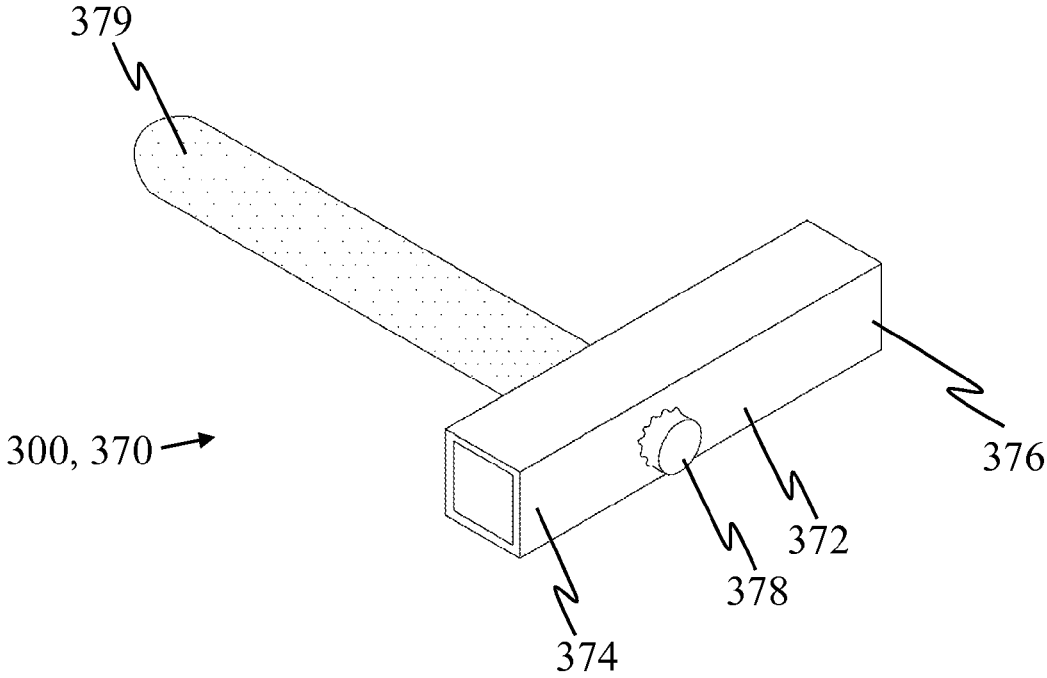
FIG. 17D is a perspective view of the embodiment of FIG. 17C of the tree step system illustrating the offset design of the T-shaped stop step affording adjustability of the stop step depth when installed with the top member according to the present invention.

Stop Step Holder:

A stop step holder 175 may be an adjustable fastener aperture 176 disposed in the upper tubing 114 further disposed on the opposing end of the upper tubing 114 from the step lag screw 130. In one embodiment, the stop step holder 175 may be an aperture 177 wherein the shape of the aperture of the stop step holder 175 is shaped to match and allow for the insertion of the horizontal structure 372. In another embodiment, the stop step holder 175 may be an aperture 177 wherein the shape of the aperture of the stop step holder 175 is shaped to match and allow for the insertion of the adjustable fastener 170. The centerline of the stop step holder 175 may be parallel with the centerline of the step lag screw 130. The aperture may be a shaped cutout in the tubing as depicted in FIG. 16C or as shown in FIGS. 16A and 16B a stop step holder 175 element wherein the shaped aperture is secured with the opposing end of the tubing 110 from the step lag screw 130. In one embodiment, the stop step holder 175 may be securely attached near or on the end of the tubing 110 and on the opposing end of the tubing 110 from the step lag screw 130. The stop step holder 175 may be secured with the end of the tubing 110 by securing methods including but not limited to welding, pining, gluing, bolting, or screwing. The stop step holder 175 provides for easy, convenient attaching and removing of the stop step 370 with the tree step system tubing 110, 114. In addition, the stop step holder 175 may receive either portion of the stop step horizontal structure 372 such that when one portion of the horizontal structure is longer 376 than the other portion of the horizontal structure 374 either the longer or shorter portion 376, 374 of the horizontal structure 372 may be received in the stop step holder 175 thus providing an adjustable stop step for different size trees 20.

Figure 15A:
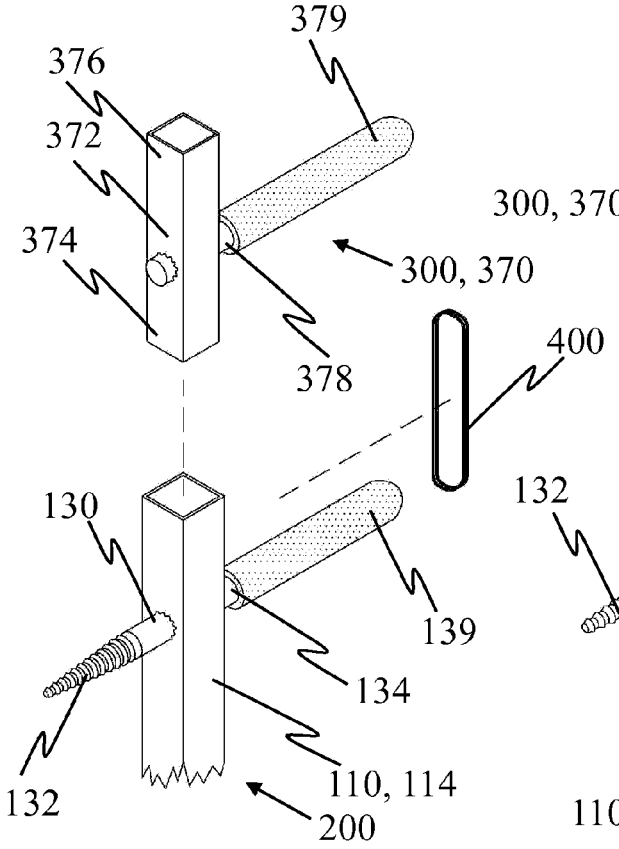
FIG. 15A is a perspective view of another embodiment of the tree step system illustrating a feature for stowing the stop step with the top member when not in use with a tree according to the present invention.
Figure 15B:
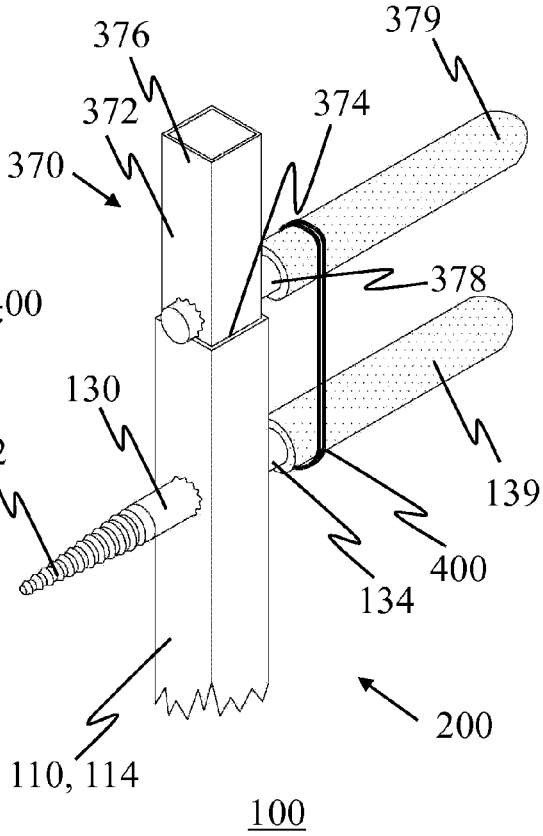
FIG. 15B is a perspective view of the embodiment of the tree step system of FIG. 14A illustrating a stowed position of the stop step with the top member.

Stop Step:

Normally a stop step 370 is a bottom member 300. The stop step 370 may include a T-shaped tubing wherein the T-shape includes a horizontal structure 372 and a vertical structure 378 to form the T-shape. In addition, the T-shape may be offset such that the vertical structure 378 is not in the center of the horizontal structure 372 wherein one portion of the horizontal structure 372 is longer 376 than the other portion 374 of the horizontal structure 372. The vertical structure 378 of the T-shape provides a step for climbing a tree. With one embodiment, the vertical structure 378 may include a flexible sticky material, rubber grip, or grip tape 379 for improving the footing and the hand grip associated with the vertical structure 378. The horizontal structure 372 provides a means for stopping the tree step system 100 from rotating about the lag screw, threaded element 132 such that when weight is placed on the step or vertical structure 378 of the T-shape, the horizontal structure 372 contact the tree 20 and restricting the further rotation of the tree step system 100 thus stopping the tree step system from rotating in relation to the tree. The horizontal structure also provides an easy, convenient way to attach and remove the stop step in relation to the stop step holder. The horizontal structure 372 is inserted in the stop step holder 175 such that the horizontal structure 372 is approximately parallel with the centerline of the step lag screw 130. The design of the stop step 370 further provides for a convenient attachment and removal of the stop step 370 from the stop step holder 175. In one embodiment, the tree step system 100 may comprise a stop step holder 175 and a step lag screw 130 attached with an upper tubing 114, and a bottom member 300 comprising a T-shaped stop step 370 for inserting in the stop step holder 175 for stopping the rotation of the tree step system 100 in relation to the tree 20 and providing a step for climbing the tree. The stop step 370 may include but is not limited to shapes that are square, rectangular, oval, or round. When needed, a key may be provided to eliminate rotation of the horizontal structure 372 within the stop step holder 175. With some embodiments as depicted in FIGS. 15A and 15B, the horizontal structure of the stop step 370 may be inserted in the step lag screw end of the upper tubing 110, 114 such that the top member 200 and the bottom member 300 may be combined or fastened together with a natural or synthetic elastic material used as a removable and attachable fastener such as a small bungee cord or a durable elastic band 400 for storage or carrying. This permits a carry or transportation position for the stop step 370 bottom member 300 combined with the top member 200.

Adjustable Fastener:

As illustrated in FIGS. 1, 2, 11A, 11B, 13A, 14A, through 14D, and 17A, through 17D, the tree step system 100 may include an adjustable fastener 170. The adjustable fastener 170 allows the tree step system 100 to accommodate different tree diameters and prohibit the tree step system 100 from rotating to a perpendicular position which might limit foot accessibility to the lower step, or rod step 150. The adjustable fastener 170 provides adjustability for the depth of the adjustable fastener 170, wherein the adjustable fastener 170 may contact a tree curvature preventing the tree step system 100 from rotating. With the adjustable fastener 170, the tubing 110 may comprise an adjustable fastener aperture or an aperture type stop step holder 176 wherein the adjustable fastener aperture or the stop step holder centerline may be parallel with the centerline of the step lag screw 130. The adjustable fastener 170 may pass through the adjustable fastener aperture 176 through the tubing 110 where the embodiment is a single tubing 110; or where the embodiment is a multi-member embodiment, through the upper and lower tubing 114, 124; or through either the upper or lower tubing 114, 124 and the inner tubing 128 where the multi-member embodiment includes an inner tubing 128. The adjustable fastener aperture 176 or the stop step holder 175 may pass through or attach with the upper tubing 114. With the multi-member embodiments, the adjustable fastener 170 may attach the top member 200 with the bottom member 300. The adjustable fastener 170 may be inserted in the top member adjustable fastener aperture 260 and the bottom member adjustable fastener aperture 360. The adjustable fastener 170 may include but is not limited to thumb screw, jamb nut, wing nut combinations, clevis pin, hairpin combinations, conventional nut, bolt combinations, or a pin with a clip combination. As shown in FIGS. 7B and 8B, the adjustable fastener 170 may have at least one adjustable clip aperture 174 in the adjustable fastener 170 and an adjustable clip 172 such that the disposition of the adjustable clip 172 in the desired adjustable clip aperture 174 may adjust the depth of the adjustable fastener 170, and such that the adjustable fastener 170 may secure the top member 200 and bottom member 300 together.

Rod Step:

With some embodiments, the rod step 150 may include the flexible sticky material, rubber grip, or grip tape 139 as used with the step lag screw 130 for improving the footing and the hand grip associated with the rod step 150.

Figure 10:
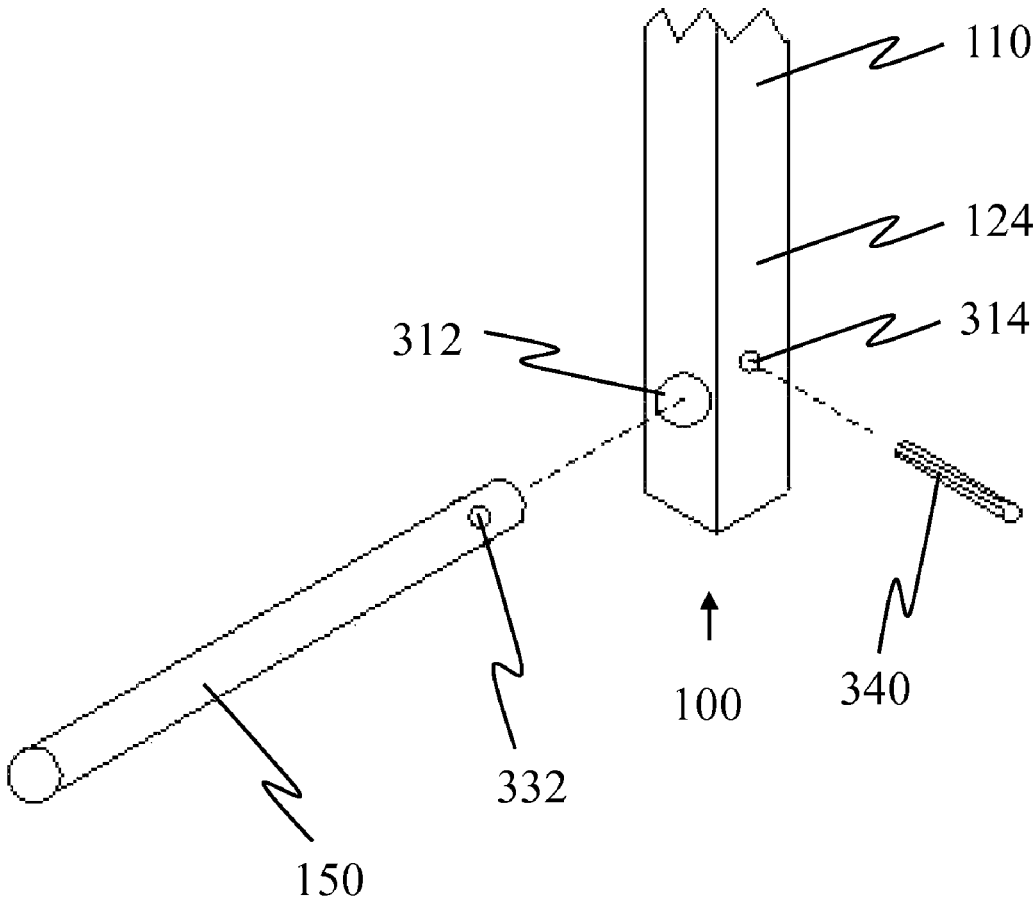
FIG. 10 is a perspective view of an embodiment of the rod step assembly with tubing according to the present invention.
Figure 11A:
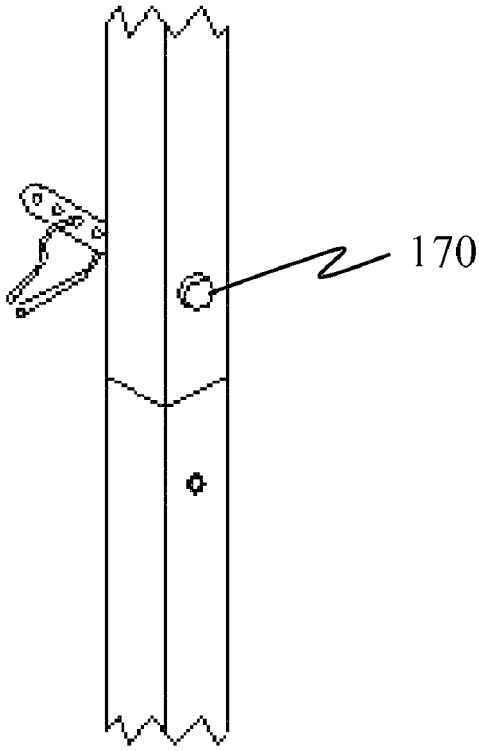
FIG. 11A is a perspective view of another embodiment of a tree step system showing an adjustable fastener with a top member and a bottom member according to the present invention.
Figure 11B:
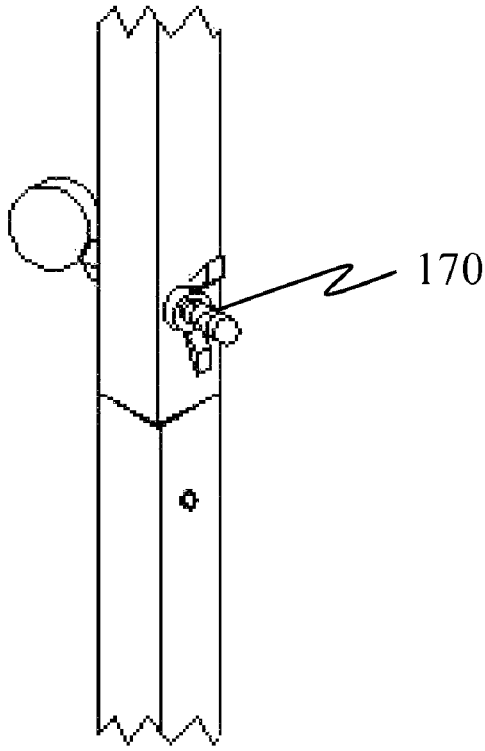
FIG. 11B is a perspective view of yet another embodiment of a tree step system showing another adjustable fastener with a top member and a bottom member according to the present invention.

As shown in FIG. 10, the tree step system 100 may include a rod step 150 secured with the tubing 110 distal from the step lag screw 130. For a multi-member embodiment, the rod step 150 may be secured with the lower tubing 124 distal from the end of the lower tubing 124 that attaches with the upper tubing 114. The rod step 150 and the tubing 110 may be secured together by being formed as one molding or formed separately and joined together. One embodiment may include a metal rod step, other embodiments may include a composite or plastic rod step while even other embodiments may include the metal rod step embedded in the plastic or composite. One embodiment may comprise a tubing 110 with having a rod step aperture 312 or hole for the rod step 150 to be inserted into and the tubing 110 and the rod step 150 having a rod step pin aperture 332 wherein a rod step pin 340 may be inserted into the rod step aperture 312 to secure the rod step 150 with the tubing 110. Other embodiments for securing the rod step 150 with the tubing 110 may include but not be limited to pins, conventional nuts and bolts, welding, glue, rivets, or clips. The tree step system 100 may be finished with material coating including but not limited to painting, plating, powder coating, or camouflage taping.

Figures 5A, 5B, 5C:
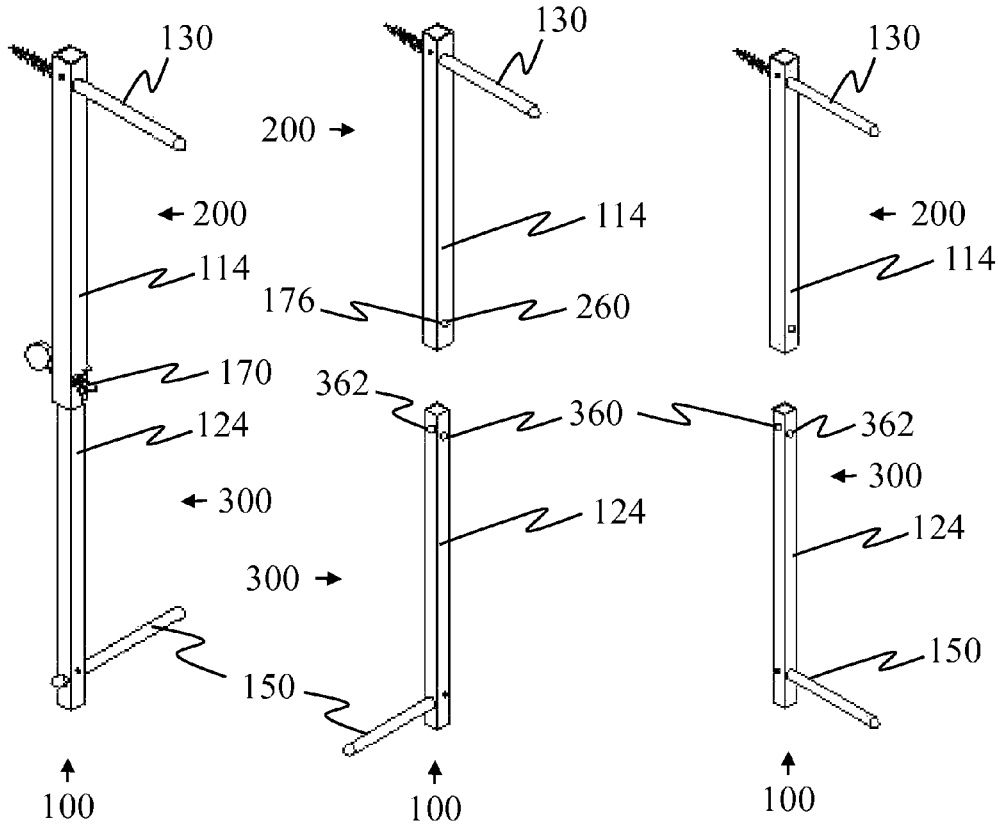
FIG. 5A is a perspective view of an embodiment showing the assembly wherein one member is inserted into the other for a tree step system according to the present invention.
FIG. 5B is a perspective view of yet another embodiment the tree step system assembled with the rod step offset 180 degrees from the embodiment in FIG. 5A according to the present invention.
FIG. 5C is a perspective view of yet another embodiment the tree step system assembled with the rod step offset 90 degrees from the embodiment in FIG. 5A according to the present invention.
Figure 12:
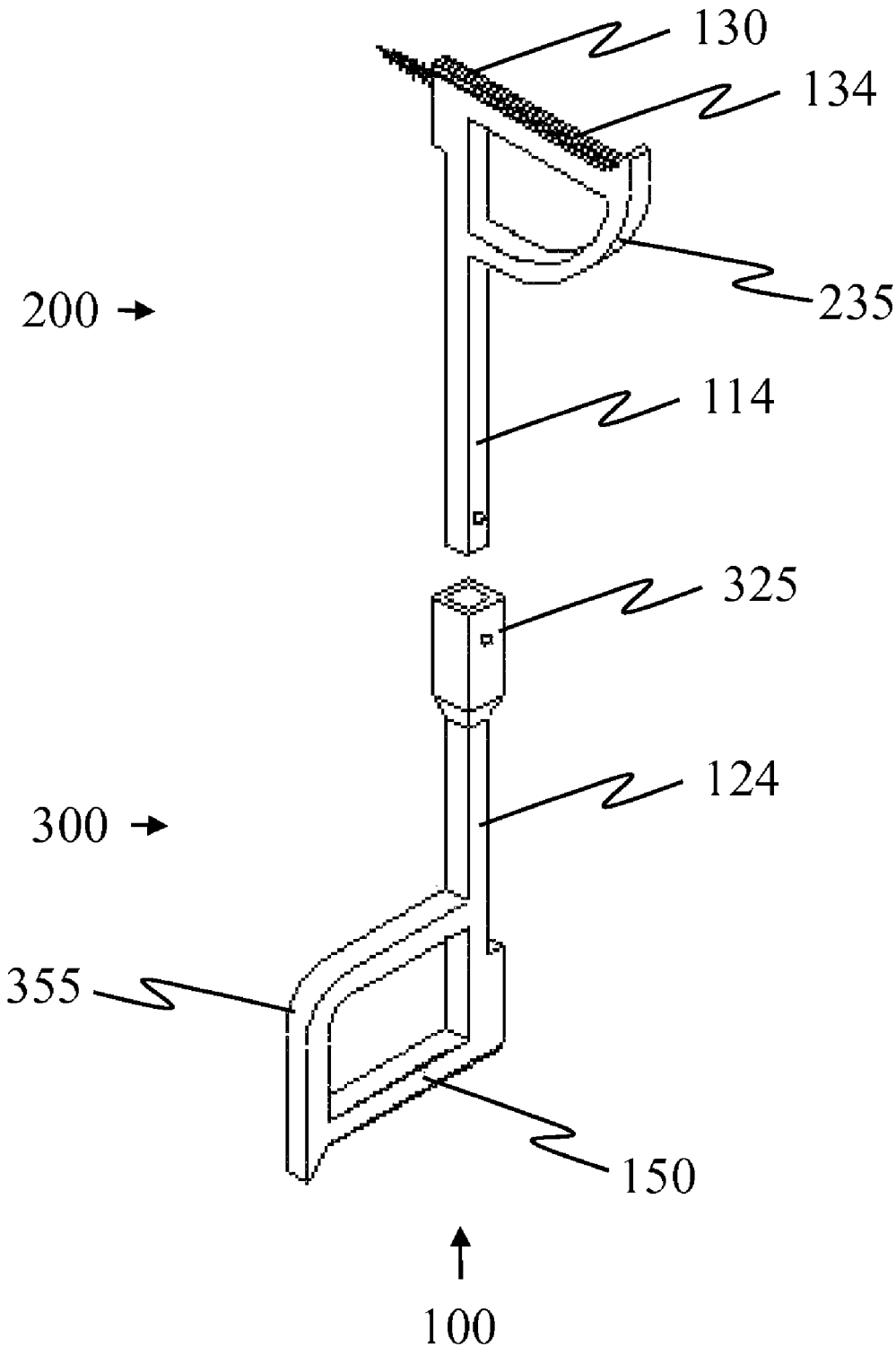
FIG. 12 is a perspective view of another embodiment of the tree step system illustrating one molded fabrication design according to the present invention.

Assemblies and Rod Step Alignment:

As shown in FIGS. 5A and 5B, one embodiment may include a top member 200 that includes an upper tubing 114, a top member adjustable fastener aperture 260, a step lag screw 130 wherein the step lag screw 130 is secured to the upper tubing 114, a bottom member 300 that includes a lower tubing 124, a bottom member adjustable fastener aperture 360, a rod step 150 wherein the rod step 150 is secured to the lower tubing 124, and an adjustable fastener 170 wherein the top member 200 and the bottom member 300 may be attached by inserting one member into the other member and the top member 200 and the bottom member 300 may be attached by inserting the adjustable fastener 170 in the top member adjustable fastener aperture 260 and the bottom member adjustable fastener aperture 360. Normally, the bottom member adjustable fastener aperture 360 centerline is ninety degrees offset from the rod step 150 as depicted in FIGS. 5B, 5A, and 8A. However, the bottom member adjustable fastener aperture 360 may be parallel with the rod step 150 as depicted in FIG. 5C as a bottom member ninety degree adjustable fastener aperture 362. Another embodiment may include both the bottom member adjustable fastener aperture 360 which is offset from the rod step 150 ninety degrees and the bottom member ninety degree adjustable fastener aperture 362 bottom member ninety degree adjustable fastener aperture 362 which is parallel with the rod step 150. With the dual configuration bottom member adjustable fastener apertures 360, 362 the rod step may be positioned in ninety degree increments from ninety degrees offset from the step lag screw 130 in one direction, to parallel with the step lag screw 130, to ninety degrees offset from the step lag screw 130 in the other direction. As previously described the adjustable fastener 170 with the adjustable clip apertures 174 and the adjustable clip 172 may be used in one embodiment to adjust the depth of the adjustable fastener 170 for the diameter of the tree 20 and the resulting tree curvature. In another embodiment as depicted in FIGS. 7A and 7B, the tree step system 100 may further comprise an inner tubing 128 wherein the inner tubing 128 may be inserted into the upper tubing 114 and the lower tubing 124 to aid in attaching the top member 200 and the bottom member 300; or as depicted in FIGS. 8A and 8B, in one embodiment the tree step system top member 200 may further comprise an inner tubing 128 wherein the inner tubing 128 may be inserted into the upper tubing 114 and the lower tubing 124 to aid in attaching the top member 200 and the bottom member 300, wherein the inner tubing 128 is secured with the upper tubing 114 and the top member inner tubing 128 may be inserted into the lower tubing 124; or as depicted in FIGS. 5A, 5B, and 5C in yet another embodiment, the tree step system 100 wherein the bottom member 300 further comprises a bottom member ninety degree adjustable fastener aperture 362 rotated ninety degrees from the bottom member adjustable fastener 170 on the plane of the lower tubing 124 such that the bottom member 300 may be inserted into the upper member at ninety degree increments such that the rod step 150 may be positioned in alignment with the step lag screw 130; or in still another embodiment, the tree step system 100 wherein the top member 200 and the bottom member 300 may be constructed of steel; or in another embodiment wherein the top member 200 and the bottom member 300 may be attached together with a positive stop aligning the top member adjustable fastener aperture 260 and the bottom member adjustable fastener aperture 360. In another embodiment as depicted in FIG. 12, the tree step system 100 wherein the upper tubing 114 and the step lag screw 130 may comprise a plastic composite molded together and wherein the lower tubing 124 and the rod step 150 may comprise a plastic composite molded together and wherein the top member 200 further comprises a top member radius section 235 joining the step element 134 of the step lag screw 130 and the upper tubing 114 for support and wherein the bottom member 300 further comprises a bottom member radius section 355 joining the rod step 150 and the lower tubing 124 for support and wherein the bottom member 300 further comprises an outer sleeve 325 on the distal end of the lower tubing 124 from the rod step 150 for receiving the top member 200 whereby the top member 200 and the bottom member 300 may be attached. As shown in FIGS. 8A and 8B, another embodiment may include a top member 200 that includes an upper tubing 114, a top member adjustable fastener aperture 260, a step lag screw 130 wherein the step lag screw 130 is secured to the upper tubing 114, a bottom member 300 that includes a lower tubing 124, a bottom member adjustable fastener aperture 360, a rod step 150 wherein the rod step 150 is secured to the lower tubing 124, and an adjustable fastener 170 wherein the top member 200 and the bottom member 300 may be attached by inserting one member into the other member and the top member 200 and the bottom member 300 may be attached by inserting the adjustable fastener 170 in the top member adjustable fastener aperture 260 and the bottom member adjustable fastener aperture 360. The bottom member 300 may further include an inner tubing 128 wherein the inner tubing 128 may be inserted in the lower tubing 124, wherein the bottom member adjustable fastener aperture 360 is an inner tubing adjustable fastener aperture 324 and the inner tubing 128 is secured with the lower tubing 124 and the bottom member 300 such that the inner tubing 128 may be inserted into the upper tubing 114 and attached with the adjustable fastener 170 wherein the top member adjustable fastener aperture 260 is the upper tubing 114 adjustable fastener aperture 176 and the bottom member adjustable fastener aperture 360 is the inner tubing adjustable fastener aperture 324, wherein the adjustable fastener centerline is parallel with the step lag screw centerline and the rod step centerline is ninety degrees from the step lag screw centerline. As illustrated in FIGS. 2, 3A, 3B, 8A, 8B, 10, 11A, and 11B, in another embodiment, the tree step system 100: the upper tubing 114 may further have a step lag screw aperture 212, and an upper tubing step lag screw pin aperture 214; the step lag screw 130 may further have a step lag screw pin aperture 136, wherein the step lag screw 130, the threaded element 132, and the step element 134 is straight without curves and bends; the top member 200 may further include a step lag screw pin 138, wherein the step lag screw 130 is inserted in the step lag screw aperture 212 in the upper tubing 114 and the step lag screw pin 138 may be inserted through the upper tubing step lag screw pin aperture 214 and the step lag screw pin aperture 136; the lower tubing 124 may further have a lower tubing rod step aperture 312, a lower tubing rod step pin aperture 314, and a lower inner tubing pin aperture 318; the bottom member 300 may further include a rod step pin 340, the rod step 150 having a rod step pin aperture 332, wherein the rod step 150 is inserted in the lower tubing rod step aperture 312 and the rod step pin 340 may be inserted through the lower tubing rod step pin aperture 314 and the rod step pin aperture 332 wherein the rod step 150 is secured to the lower tubing 124, and wherein the inner tubing 128 having an inner lower tubing pin aperture 322 and wherein the bottom member 300 further including a lower inner tubing pin 350 that may be inserted in the inner lower tubing pin aperture 322 and the lower inner tubing pin aperture 318, whereby the lower tubing 124 is secured to the inner tubing 128. In still another embodiment, the tree step system bottom member 300 may be rotated 180 degrees whereby the rod step 150 may be disposed on the opposite side of the tree step system 100 to enable the user to climb around limbs and enter a tree stand with the proper foot. The inner tubing 128 may be secured with the upper or lower tubing 114, 124 by securing methods including but not limited to welding, pining, gluing, bolting, or screwing.

Figure 2:
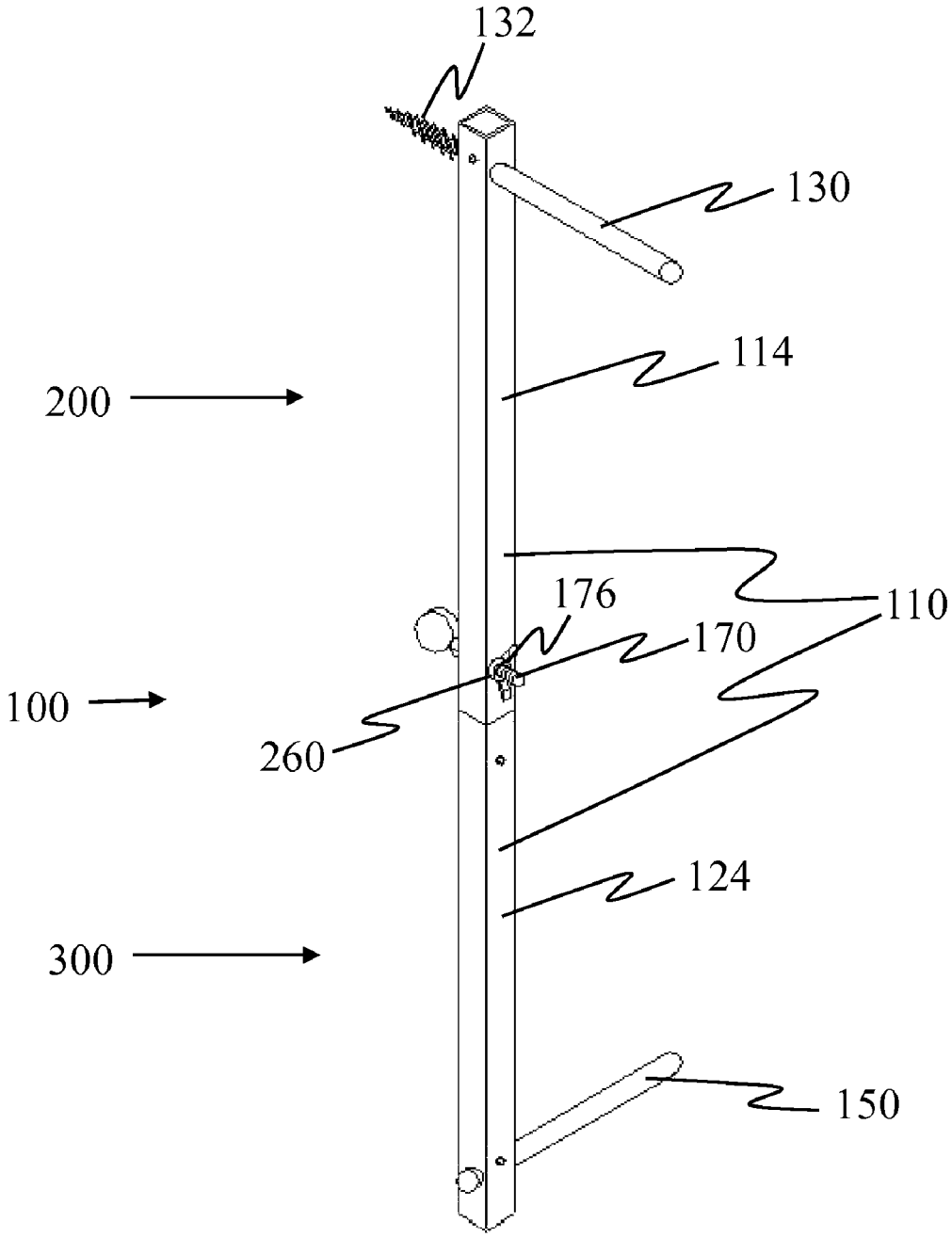
FIG. 2 is a perspective view of one embodiment of the tree step system assembled according to the present invention.

Manner of Use:

A method of utilizing a tree step system 100 is illustrated in FIGS. 1, 2, and 8B comprising the steps of: grasping an end of an upper tubing 114 opposite a threaded element 132 of a top member 200 of the tree step system; swinging the top member 200 of the tree step system 100 toward a tree 20 similar to a hammer whereby the threaded element 132 of the tree step system starts to penetrate the tree 20; rotating the top member 200 of the tree step system 100 by gripping the upper tubing 114 opposite the threaded element 132 such that the upper tubing 114 provides leverage for turning the threaded element 132 and further penetrating the tree 20; stopping the rotation of the top member 200 wherein the upper tubing 114 opposite the threaded element 132 is offset from the centerline of the tree such that a bottom member 300 of the tree step system 100 may be inserted in the top member 200 of the tree step system 100 and an adjustable fastener 170 may be inserted in the top and bottom members 200, 300 to keep the tree step system 100 from rotating when weight is applied to a bottom member rod step 150; inserting the bottom member 300 in the top member 200 with the rod step centerline 90 degrees offset from the threaded element 132; inserting the adjustable fastener 170 in a top and bottom member adjustable fastener aperture 260, 360; and inserting a adjustable fastener clip 172 in an adjustable fastener clip aperture 174 such that the adjustable fastener 170 is the depth needed for the tree diameter to prevent rotation of the tree step system 100 when weight is applied to the bottom member rod step 150.

Another embodiment of the method of utilizing a tree step system 100 is illustrated in FIGS. 1, 2, and 8B comprising the steps of: grasping an end of an upper tubing 114 opposite a threaded element 132 of a top member 200 of a tree step system; swinging the top member 200 of the tree step system 100 toward a tree 20 similar to a hammer whereby the threaded element 132 of the tree step system 100 starts to penetrate the tree 20; rotating the top member 200 of the tree step system 100 by gripping the upper tubing 114 opposite the threaded element 132 such that the upper tubing 114 provides leverage for turning the threaded element and further penetrating the tree 20; stopping the rotation of the top member 200 wherein the upper tubing 114 opposite the threaded element 132 is offset from the centerline of the tree such that a bottom member 300 of the tree step system 100 may be inserted in the top member 200 of the tree step system 100 and an adjustable fastener 170 may be inserted in the top and bottom members 200, 300 to keep the tree step system 100 from rotating when weight is applied to a bottom member rod step 150; rotating the bottom member step 180 degrees when desired such that the step is on the opposite side for avoiding a tree branch and for entering a tree stand with the proper foot; inserting the bottom member 300 in the top member 200 with the rod step centerline 90 degrees offset from the threaded element; inserting the adjustable fastener 170 in a top and bottom member adjustable fastener aperture 260, 360; and inserting a adjustable fastener clip 172 in an adjustable fastener clip aperture 174 such that the adjustable fastener 170 is the depth needed for the tree diameter to prevent rotation of the tree step system 100 when weight is applied to the bottom member rod step 150.

Figure 14A:
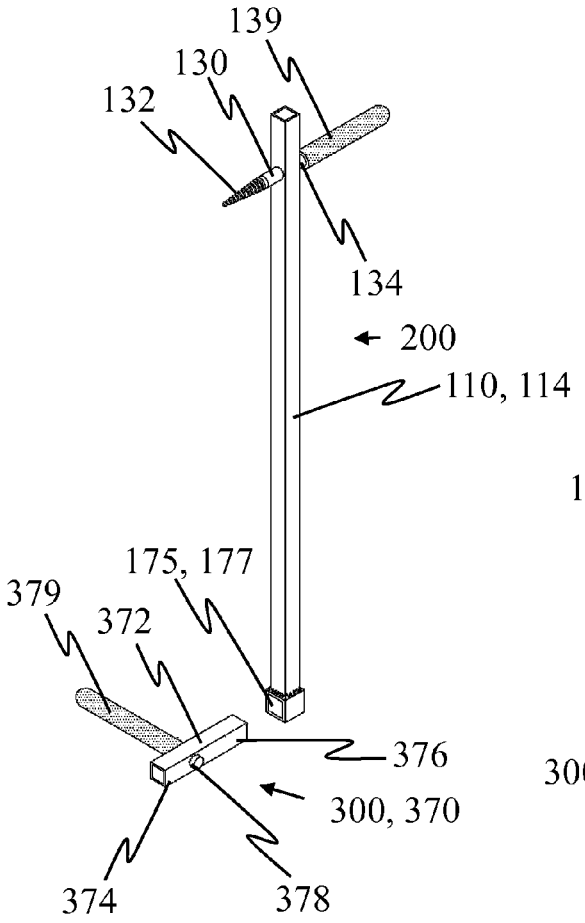
FIG. 14A is a perspective view of an embodiment of the tree step system illustrating a means for stepping and stopping rotation according to the present invention.
Figure 14B:
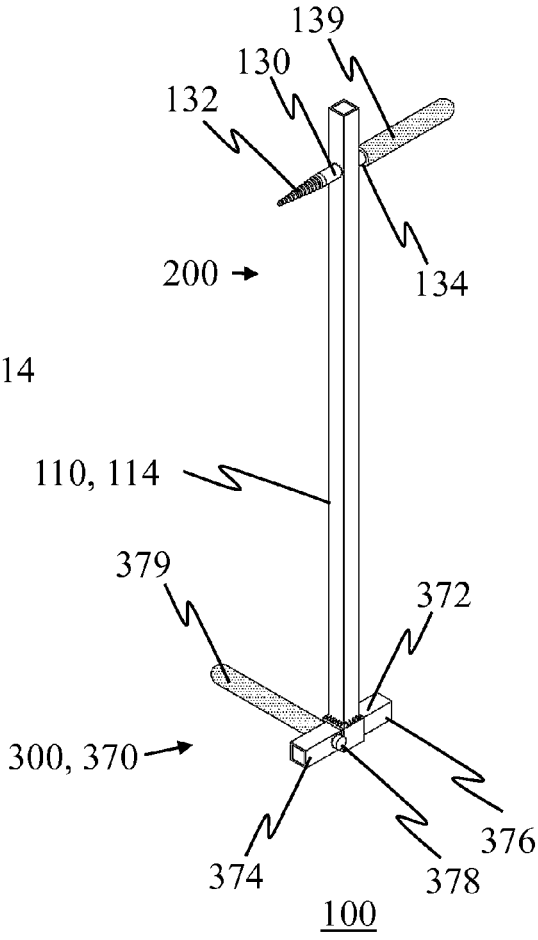
FIG. 14B is a perspective view of the embodiment of the tree step system of FIG. 14A illustrating the means for stepping and stopping rotation inserted in a means for holding the stepping and stopping rotation according to the present invention.
Figure 14C:
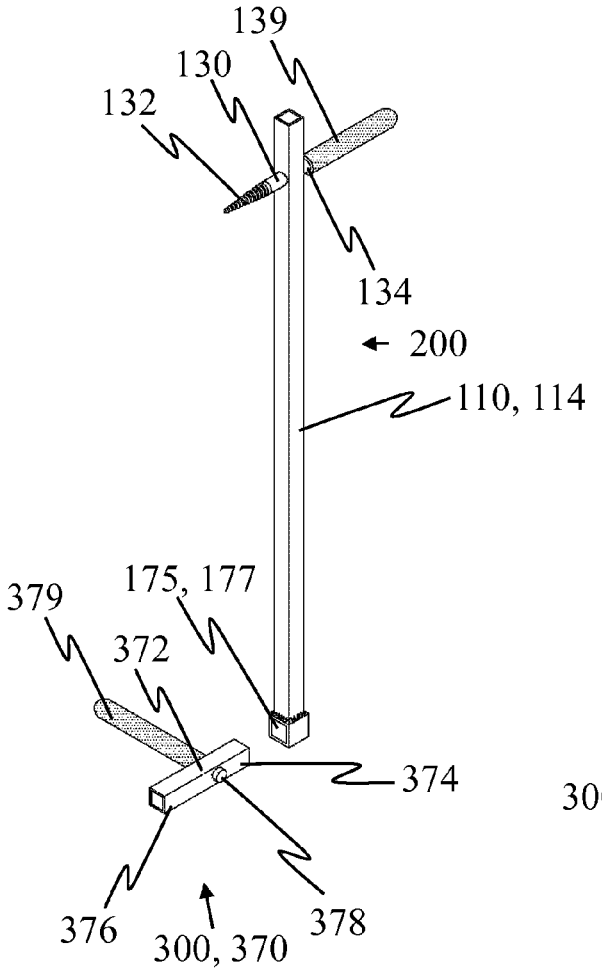
FIG. 14C is a perspective view of an embodiment of the tree step system illustrating an offset of the means for stepping and stopping rotation for adjusting the depth of the means for stepping and stopping rotation according to the present invention.
Figure 14D:
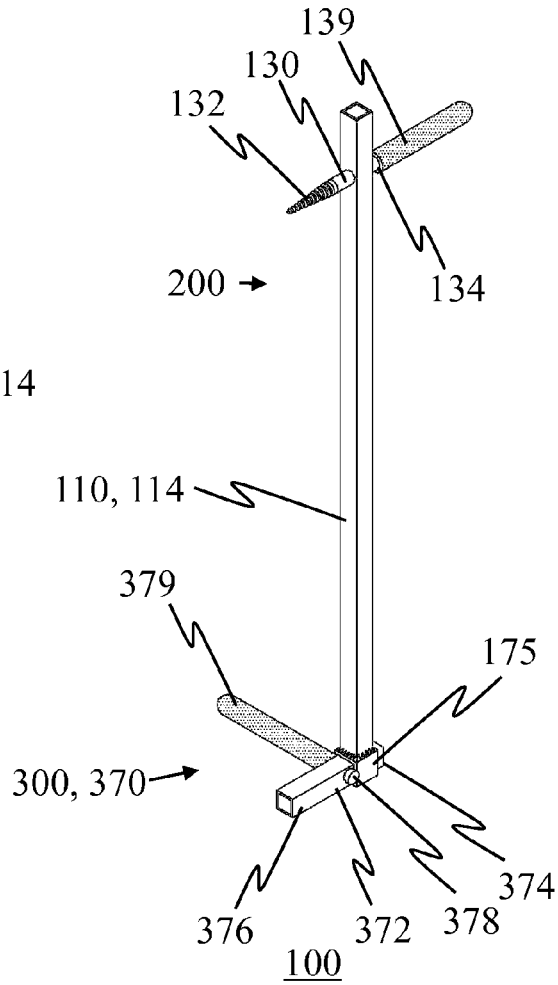
FIG. 14D is a perspective view of the embodiment of the tree step system of FIG. 14C illustrating the means for stepping and stopping rotation inserted in a means for holding the means for stepping and stopping rotation with a longer depth than FIG. 14B according to the present invention.

Yet another method of utilizing a tree step system 100 is illustrated in FIGS. 13, 14C, and 14D, the method comprising the steps of: grasping an end of an upper tubing 114 opposite a threaded element 132 of a top member 200 of the tree step system 100; swinging the top member 200 of the tree step system 100 toward a tree 20 in a hammer motion whereby the threaded element 132 of the tree step system 100 penetrates the tree 20; rotating the top member 200 of the tree step system 100 by gripping the upper tubing 114 opposite the threaded element 132 such that the upper tubing 114 provides a leverage force for turning the threaded element 132 and further penetrating the tree 20; stopping the rotation of the top member 200 wherein the end of the upper tubing 114 opposite the threaded element 132 is offset from the centerline of the tree such that horizontal portion 374 of a T-shaped stop step 370 bottom member 200 of the tree step system 100 may be inserted in a stop step holder 175 of the top member 200 of the tree step system 100; inserting the T-shaped stop step 370 bottom member 300 horizontal portion 374 such that the stop step horizontal portion 376 prevents rotation of the tree step system 100 when weight is applied to the bottom member 300 stop step 370; and continue rotating the top member 200 of the tree step system 100 by gripping the upper tubing 114 opposite the threaded element 132 such that the upper tubing 114 provides a leverage force for turning the threaded element 132 and rotate the tree step system 100 until the horizontal portion 376 of the T-shaped stop step 370 bottom member horizontal portion 376 stops rotating due to contacting the trunk of the tree.

Another feature of the tree step system 100 is an inherent theft deterrent capability when the bottom member 300 is removed from the tree step system 100 after installation on the tree as shown in FIG. 1. Some or all of the bottom members 300 may be removed to deter thieves from climbing the steps and stealing the tree step system 100. With the removal of these steps it would be difficult for the thief to negotiate the gap between the remaining steps.

What is claimed is:

1. A tree step system comprising:

a step lag screw comprising a threaded element and an upper step;

a means for driving the step lag screw with a hammer motion into a tree wherein the means for driving further includes a means for rotating the step lag screw with a turning motion such that a leveraged force is used for rotating the step lag screw into the tree wherein the step lag screw is securely attached with the means for driving and rotating;

a means for stepping for climbing the tree and stopping rotation of the tree step system in relation to the tree such that a user is supported by the means for stepping and stopping rotation; and a means for holding the means for stepping and stopping rotation wherein the means for holding the means for stepping and stopping rotation is securely attached with the opposing end of the means for driving and rotating from the step lag screw end of the means for driving and rotating and the means for holding the means for stepping and stopping rotation provides for attaching and removing the means for stepping and stopping rotation with the means for driving and rotating; and wherein the means for stepping and stopping rotation comprises a T-shaped tubing structure comprising a vertical structure of the T-shaped tubing structure and a horizontal structure of the T-shaped tubing structure, wherein the horizontal structure is inserted into the means for holding, wherein the vertical structure of the T-shaped tubing is offset with respect to a center of the horizontal structure of the T-shaped tubing such that one side of the horizontal structure of the T-shaped tubing is longer than an other side of the horizontal structure of the T-shaped tubing, wherein the means for stepping and stopping rotation is adjustable for different size trees dependent upon the side of the horizontal portion of the T that is inserted in the means for holding, the vertical structure of the T-shaped tubing further comprising a size and a strength suitable for the user for stepping on the vertical structure when the horizontal structure is inserted in the means for holding.

2. A tree step system comprising:

a top member including:

an upper tubing;

a stop step holder securely attached with the upper tubing;

wherein the step lag screw is securely attached with the upper tubing and the upper tubing is structured as a hammer to drive the step lag screw into a tree;

and the upper tubing is further structured for rotating the step lag screw wherein the upper tubing applies a leverage force to turn the step lag screw into the tree, wherein the step lag screw is disposed near an opposing end of the upper tubing from the stop step holder;

a bottom member comprising:

a stop step comprising a T-shaped tubing including a vertical structure and a horizontal structure such that a user steps on the vertical structure of the T-shape and the horizontal structure of the T-shaped tubing includes one portion of the horizontal structure of the T-shape inserted into the stop step holder and a next horizontal portion of the horizontal structure that contacts the tree trunk and stops rotation of the tree step system in relation to the tree.

3. The tree step system according to claim 2 wherein the horizontal portions of comprises a shorter horizontal portion of the horizontal structure and a longer horizontal portion of the horizontal structure wherein the stop step includes an adjustable length for different size tree trunks depending upon whether the shorter portion or the longer portion of the horizontal structure is inserted in the stop step holder.

4. The tree step system according to claim 3 wherein the horizontal structure of the T-shaped tubing is inserted into the step lag screw end of the upper tubing wherein an elastic material band fastener secures the vertical structure with the step lag screw.

5. The tree step system according to claim 3 wherein the vertical structure of the T-shaped tubing comprises a round shape exterior wherein the exterior of the round vertical structure comprises a flexible sticky material for improving footing and grip.

6. The tree step system according to claim 3 wherein the vertical structure of the T-shaped tubing comprises a square shaped interior and exterior vertical structure.

7. A method of utilizing a tree step system comprising the steps of: providing a top member including: an upper tubing; a stop step holder securely attached with the upper tubing; a step lag screw comprising a threaded element and an upper step; wherein the step lag screw is securely attached with the upper tubing, wherein the step lag screw and the upper step are disposed near an opposing end of the upper tubing from the stop step holder;

grasping an end of the upper tubing opposite the threaded element of the top member of the tree step system;

swinging the top member of the tree step system toward a tree in a hammer motion whereby the threaded element of the tree step system penetrates the tree;

rotating the top member of the tree step system by gripping the upper tubing opposite the threaded element such that the upper tubing provides a leverage force for turning the threaded element and further penetrating the tree;

stopping the rotation of the top member wherein the end of the upper tubing opposite the threaded element is offset from the centerline of the tree;

further providing a bottom member comprising: a stop step comprising a T-shaped tubing including a vertical structure and a horizontal structure, inserting one portion of the horizontal structure of the T-shape into the stop step holder such that a next horizontal portion of the horizontal structure stops rotation of the tree step system in relation to the tree when weight is applied to the bottom member stop step vertical member; and continue rotating the top member of the tree step system by gripping the upper tubing opposite the threaded element such that the upper tubing provides a leverage force for turning the threaded element and rotate the tree step system until the horizontal portion of the T-shaped stop step bottom member horizontal portion stops rotating due to contacting the trunk of the tree.

* * * * *